US011580900B1

(12) United States Patent
Xu

(10) Patent No.: US 11,580,900 B1
(45) Date of Patent: Feb. 14, 2023

(54) PIXEL DRIVING CIRCUIT AND METHOD, AND DISPLAY DEVICE

(71) Applicant: Glenfly Tech Co., Ltd., Shanghai (CN)

(72) Inventor: Wenwei Xu, Shanghai (CN)

(73) Assignee: GLENFLY TECH CO., LTD., Shanghai (CN)

( * ) Notice: Subject to any disclaimer, the term of this patent is extended or adjusted under 35 U.S.C. 154(b) by 0 days.

(21) Appl. No.: 17/838,720

(22) Filed: Jun. 13, 2022

(30) Foreign Application Priority Data

Jan. 4, 2022 (CN) ..... 202210004410.8

(51) Int. Cl.
*G09G 3/32* (2016.01)

(52) U.S. Cl.
CPC ..... *G09G 3/32* (2013.01); *G09G 2300/0819* (2013.01); *G09G 2300/0842* (2013.01); *G09G 2310/0291* (2013.01); *G09G 2310/08* (2013.01); *G09G 2320/0233* (2013.01)

(58) Field of Classification Search
None
See application file for complete search history.

(56) References Cited

U.S. PATENT DOCUMENTS

| | | | | |
|---|---|---|---|---|
| 2018/0218676 | A1 | 8/2018 | He et al. | |
| 2021/0295785 | A1* | 9/2021 | Huang | G09G 3/3233 |
| 2022/0173199 | A1* | 6/2022 | Yamamoto | G09G 3/3275 |

FOREIGN PATENT DOCUMENTS

| | | | |
|---|---|---|---|
| CN | 102163402 | A | 8/2011 |
| CN | 106328061 | A | 1/2017 |
| CN | 106652913 | B | 11/2018 |
| CN | 110136638 | A | 8/2019 |
| CN | 111063298 | A | 4/2020 |
| CN | 109658865 | B | 1/2021 |

OTHER PUBLICATIONS

China Intellectual Property Office: Office Action of Chinese Application No. 202210004410.8 (related application); dated Sep. 26, 2022; 9 pages.

* cited by examiner

*Primary Examiner* — Christopher J Kohlman
(74) *Attorney, Agent, or Firm* — Gregory M. Howison

(57) ABSTRACT

Disclosed are a pixel driving circuit and method, and a display device. The pixel driving circuit includes: the first port of the operation module is electrically connected via the first switch unit to the compensation wire connected to the pixel driving module, the second port of the operation module is electrically connected to the compensation wire through the second switch unit; the first switch unit is configured to transmit the driving data provided by the pixel driving module to the operation module in the self-discharge phase, and the operation module is configured to perform the calculation on the driving data in the self-discharge phase to obtain compensation data; the second switch unit is configured to write the compensation data into the pixel driving module through the compensation wire in the data writing stage.

12 Claims, 5 Drawing Sheets

PIXEL DRIVING CIRCUIT AND METHOD, AND DISPLAY DEVICE

CROSS-REFERENCE TO RELATED APPLICATIONS

This application claims priority to and/or benefit from Chinese patent application No. 202210004410.8, filed Jan. 4, 2022, entitled PIXEL DRIVING CIRCUIT AND METHOD, AND DISPLAY DEVICE, the content of which is hereby incorporated by reference in its entirety.

TECHNICAL FIELD

The present disclosure relates to the technical field of display devices, and particularly to a pixel driving circuit and method, and a display device.

BACKGROUND

The silicon-based microdisplay is a special display based on the silicon semiconductor technology with a small physical size and a large field of view formed by the optical magnification. The driving method for the silicon-based microdisplay is to change the brightness of the pixel by changing the magnitude of the current inputted into the transistor. Therefore, different device characteristics may generate different currents, so that the brightness of the light is different, which affects the display effect. Due to the different threshold voltages of transistors in different positions in the display, the display screen is abnormal. Therefore, it is necessary to compensate for the threshold voltage of the transistor in each position.

The conventional display pixel driving circuit performs an internal compensation through a capacitive voltage divider, but the fluctuations of the parameters of the capacitor fabrication process may lead to changes in the capacitance value, accordingly, the compensation effect of the internal capacitive voltage divider is unsatisfactory, the driving current between each pixel is quite different, and the brightness of the display is different.

SUMMARY

In view of this, as for the technical problem described in the background art, it is necessary to provide a pixel driving circuit and method, and a display device, the external circuit is utilized to complete the real-time compensation for the threshold voltage difference between the pixels, so that the light driving current of each pixel is always consistent, and there is no difference in the display brightness of the display device, thereby improving the display effect.

In order to solve the above problem, in an embodiment of the present disclosure, a pixel driving circuit is provided, including:

a first switch unit, a second switch unit, a pixel driving module, an operation module; a first port of the operation module being connected via the first switch unit to a compensation wire connected to the pixel driving module, a second port of the operation module being connected to the compensation wire via the second switch unit;

the first switch unit being configured to transmit driving data provided by the pixel driving module to the operation module in a self-discharge phase, the operation module being configured to perform calculation on the driving data in the self-discharge phase to obtain compensation data, the second switch unit being configured to write the compensation data into the pixel driving module via the compensation wire in a data writing phase.

In the pixel driving circuit provided in the above embodiment, the pixel driving module is electrically connected to the first switch unit and the second switch unit through the compensation wire, the first port of the operation module is electrically connected to the compensation wire through the first switch unit, the second port of the operation module is electrically connected to the compensation wire through the second switch unit; in the self-discharge phase, the first switch unit is in an on state, to transmit the driving data provided by the pixel driving module to the operation module; and the operation module performs the calculation on the driving data to obtain the compensation data; and in the data writing stage, the second switch unit is turned on to write the compensation data into the pixel driving module through the compensation wire, thereby completing the compensation for the pixel driving module. Compared to the conventional compensation for the threshold voltage by using a capacitor, in the present disclosure an external circuit is utilized to complete the real-time compensation for the threshold voltage difference between pixels, so that the light driving current of each pixel is always consistent, and there is no difference in the brightness of the display device, thereby improving the display effect.

In an embodiment, the first switch unit is further configured to disconnect the compensation wire from the first port in the data writing phase, the second switch unit is further configured to disconnect the second port from the compensation wire in the self-discharge phase.

In an embodiment, the operation module comprises a first operational amplifier unit, a multiplexor unit, a NOR unit, a first adjustable resistor unit and a second adjustable resistor unit;

an input terminal of the first adjustable resistor unit is connected to a data signal;

a first input terminal of the first operational amplifier unit serves as the first port, a second input terminal of the first operational amplifier unit is connected to the output terminal of the first adjustable resistor unit and is grounded, the data signal is configured to provide a first preset voltage to the multiplexor unit in an initialization phase and provide a second preset voltage to the first operational amplifier unit in the self-discharge phase, the first operational amplifier unit performs the calculation and obtains the compensation data according to the driving data and the second preset voltage in the self-discharge phase;

a first terminal of the second adjustable resistor unit is connected to the first input terminal of the first operational amplifier unit, a second terminal of the second adjustable resistor unit is connected to the output terminal of the first operational amplifier unit;

a first input terminal of the NOR unit is connected to a first control signal, a second input terminal of the NOR unit is connected to a second control signal, an output terminal of the NOR unit is connected to a control terminal of the multiplexor unit;

a first input terminal of the multiplexor unit is connected to the data signal, a second input terminal of the multiplexor unit is connected to the output terminal of the first operational amplifier unit, and an output terminal of the multiplexor unit serves as the second port, the multiplexor unit selects and outputs the first preset voltage provided by the data signal in the initialization phase and selects and outputs the compensation data provided by the first operational amplifier unit in the self-discharge phase and the data writing phase.

In an embodiment, the operation module further includes:

a first resistor, wherein a first terminal of the first resistor is connected to the compensation wire via the first switch unit, and a second terminal of the first resistor is connected to the first terminal of the second adjustable resistor unit;

a second resistor, wherein a first terminal of the second resistor is grounded, and a second terminal of the second resistor is connected to the output terminal of the first adjustable resistor unit.

In an embodiment, the second preset voltage is greater than the first preset voltage.

In an embodiment, a resistance value of the first adjustable resistor unit is equal to a resistance value of the second adjustable resistor unit.

In an embodiment, both the first adjustable resistor unit and the second adjustable resistor unit comprise a plurality of adjustable resistor sub-units connected in series;

each adjustable resistor sub-unit comprises a preset resistor and a switch transistor corresponding to the preset resistor, a first terminal of the switch transistor is connected to a first terminal of the preset resistor, a second terminal of the switch transistor is connected to a second terminal of the preset resistor, a control terminal of the switch transistor is connected to a corresponding preset control signal.

In an embodiment, the pixel driving circuit includes a first transistor, a second transistor, a third transistor, a fourth transistor, an energy storage unit and a light emitting unit; wherein a source of the first transistor is connected to the compensation wire, a gate of the first transistor is connected to a first scan signal; a drain of the first transistor, a first terminal of the energy storage unit and a gate of the second transistor are electrically connected to a first voltage node; a source of the second transistor, a second terminal of the energy storage unit and a drain of the third transistor are electrically connected to a second voltage node; a drain of the second transistor is electrically connected to a first power supply wire via the light emitting unit;

a source of the third transistor is connected to a second power supply wire, and a gate of the third transistor is connected to a second scan signal;

a gate of the fourth transistor is connected to a third scan signal, a drain of the fourth transistor is connected to the drain of the second transistor, and a source of the fourth transistor is connected to the first power supply wire.

In an embodiment, the first transistor, the second transistor, the third transistor and the fourth transistor are PMOS transistors.

In an embodiment, the pixel driving circuit further includes:

a second operational amplifier unit, wherein a first input terminal of the second operational amplifier unit is connected to the second port, a second input terminal of the second operational amplifier unit is connected to the output terminal of the second operational amplifier unit, and the output terminal of the second operational amplifier unit is connected to the compensation wire.

In the second aspect of the present disclosure, a display device is provided, including:

a first switch unit;

a second switch unit;

a pixel driving module;

an operation module, a first port of the operation module being connected via the first switch unit to a compensation wire connected to the pixel driving module, a second port of the operation module being connected to the compensation wire via the second switch unit;

the first switch unit being configured to transmit driving data provided by the pixel driving module to the operation module in a self-discharge phase, the operation module being configured to perform calculation on the driving data in the self-discharge phase to obtain compensation data, the second switch unit being configured to write the compensation data into a light emitting unit of the pixel driving module via the compensation wire in a data writing phase to display.

In the third aspect of the present disclosure, a pixel driving method is provided, including:

controlling a first switch unit to transmit driving data provided by a pixel driving module to a first port of an operation module in a self-discharge phase; wherein the first port of the operation module is connected via the first switch unit to a compensation wire connected to the pixel driving module;

controlling the operation module to perform calculation on the driving data in the self-discharge phase to obtain compensation data;

controlling a second switch unit to write the compensation data into the pixel driving module in a data writing phase, wherein a second port of the operation module is connected to the compensation wire via the second switch unit.

The above description is merely an overview of the technical solution of the present disclosure. In order to understand the technical means of the present disclosure more clearly and implement it in accordance with the disclosed content, the present disclosure will be detailed below with reference to some embodiments of the present disclosure and the accompanying drawings.

Figure 1:
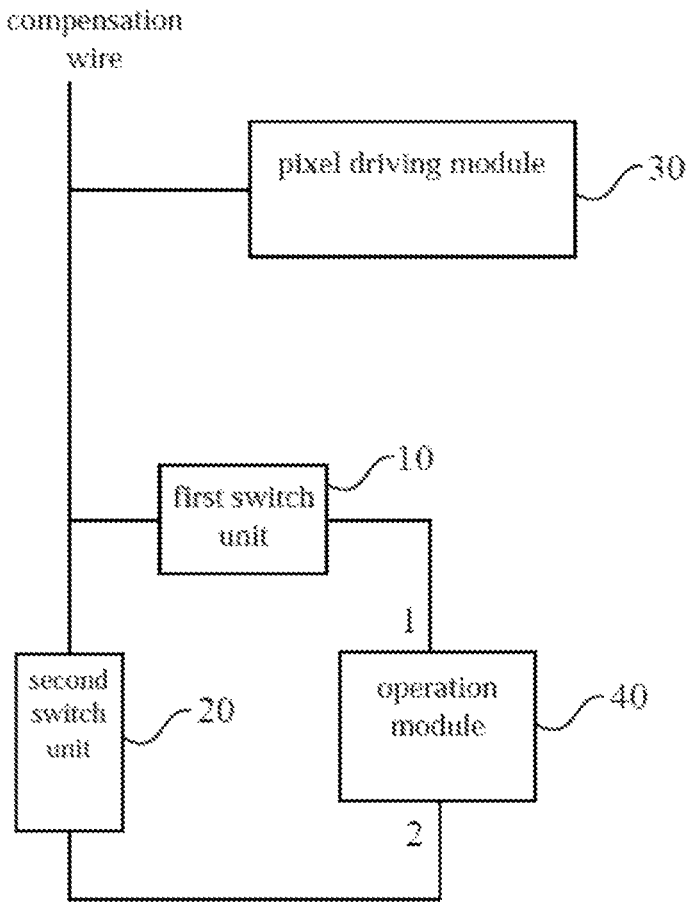
FIG. 1 is a schematic structure diagram of a pixel driving circuit according to an embodiment of the present disclosure.

Description of reference signs: 10, first switch unit; 20, second switch unit; 30, pixel driving module; 31, first transistor; 32, second transistor; 33, third transistor; 34, fourth transistor; 35, energy storage unit; 36, light emitting unit; 40, operation module; 41, first adjustable resistor unit; 410, adjustable resistor sub-unit; 4111, switch transistor; 42, first operational amplifier unit; 43, second adjustable resistor unit; 44, NOR unit; 45, multiplexor unit; 50, second operational amplifier unit.

DETAILED DESCRIPTION

In order to facilitate the understanding of the present disclosure, the present disclosure will be described in a more comprehensive manner with reference to the relevant accompanying drawings. Preferred embodiments of the present disclosure are shown in the accompanying drawings. However, the present disclosure can be implemented in many different forms and is not limited to the embodiments described herein. Rather, the purpose of providing these embodiments is to make the disclosure of present disclosure more thorough and comprehensive.

Unless otherwise defined, all technical and scientific terms used herein have the same meaning as commonly understood by those skilled in the technical field of the present disclosure. The terms used in the specification of the present disclosure herein is only for the purpose of describing specific embodiments, and is not intended to limit the present disclosure. The term "and/or" used herein includes any and all combinations of one or more related listed items.

Where "including", "having", and "comprising" are used as described herein, unless an explicit defining language is used, such as "only", "consisting of", etc., another component may also be added. Unless mentioned to the contrary, terms in the singular may include the plural and should not be construed as having a number of one.

It will be understood that, although the terms "first", "second", etc., may be used herein to describe various elements, these elements should not be limited by these terms. These terms are merely used for distinguishing one element from another. For example, a first element can be referred to as a second element; and similarly, a second element can be referred to as a first element, without departing from the scope of the present disclosure.

In this application, unless otherwise expressly specified and limited, the terms "communicated", "connected" and other terms should be understood in a broad sense, for example, it may be directly connected, or indirectly connected through an intermediate medium; or it may be an internal communication between two elements or an interactive relationship of two elements. For those of ordinary skill in the art, the specific meanings of the above terms in the present disclosure can be understood according to specific situations.

In order to illustrate the above-mentioned technical solution of the present disclosure, the following specific embodiments are used for the description.

In a pixel driving circuit provided in an embodiment of the present disclosure, as shown in FIG. 1, the pixel driving circuit includes a first switch unit 10, a second switch unit 20, a pixel driving module 30 and an operation module 40. A first port of the operation module 40 (as indicated by the sign "1" on the operation unit 40 in FIG. 1) is connected to a compensation wire connected to the pixel driving module 30 via the first switch unit 10; and a second port of the operation module 40 (as indicated by the sign "2" on the operation unit 40 in FIG. 1) is connected to the compensation wire via the second switch unit 20.

Specifically, the first switch unit 10 is configured to transmit driving data provided by the pixel driving module 30 to the operation module 40 in a self-discharge phase. The operation module 40 is configured to perform calculation on the driving data provided by the pixel driving module 30 in the self-discharge phase to obtain compensation data. The second switch unit 20 is configured to write the compensation data into the pixel driving module 30 via the compensation wire in a data writing phase.

In the pixel driving circuit provided in the above embodiment, the pixel driving module is electrically connected to the first switch unit and the second switch unit via the compensation wire; the first port of the operation module is electrically connected to the compensation wire through the first switch unit, and the second port of the operation module is electrically connected to the compensation wire through the second switch unit; in the self-discharge phase, the first switch unit is in a turn-on state to transmit the driving data provided by the pixel driving module to the operation module; and the operation module performs the calculation based on the provided driving data to obtain the compensation data; and in the data writing phase, the second switch unit is turned on to write the compensation data into the pixel driving module through the compensation wire, thereby completing the compensation for the pixel driving module. Compared to the conventional compensation for the threshold voltage by using the capacitor, in the present disclosure an external circuit is utilized to complete the real-time compensation for the threshold voltage difference between each pixel, so that the driving luminous current of each pixel is always consistent, the luminous brightness of the display device is not different, and the display effect is improved.

In an embodiment, the first switch unit 10, the second switch unit 20 and the operation module 40 together form an external compensation circuit. According to the driving data provided by the pixel driving module 30 in the self-discharge phase, the operation module 40 performs the calculation according to the driving data in the self-discharge phase to obtain the compensation data and feeds back to the pixel driving module 30 in the data writing phase to complete the compensation, so that the driving current of each pixel is consistent. Compared to the internal compensation, the external compensation has a better compensation effect and there is no difference in the display brightness.

In an embodiment, the first switch unit 10 is further configured to disconnect the compensation wire from the first port of the operation module 40 in the data writing phase. The second switch unit 20 is further configured to disconnect the second port of the operation module 40 from the compensation wire in the self-discharge phase. In the light emitting phase, both the first switch unit 10 and the second switch unit 20 are turned off.

Figure 2:
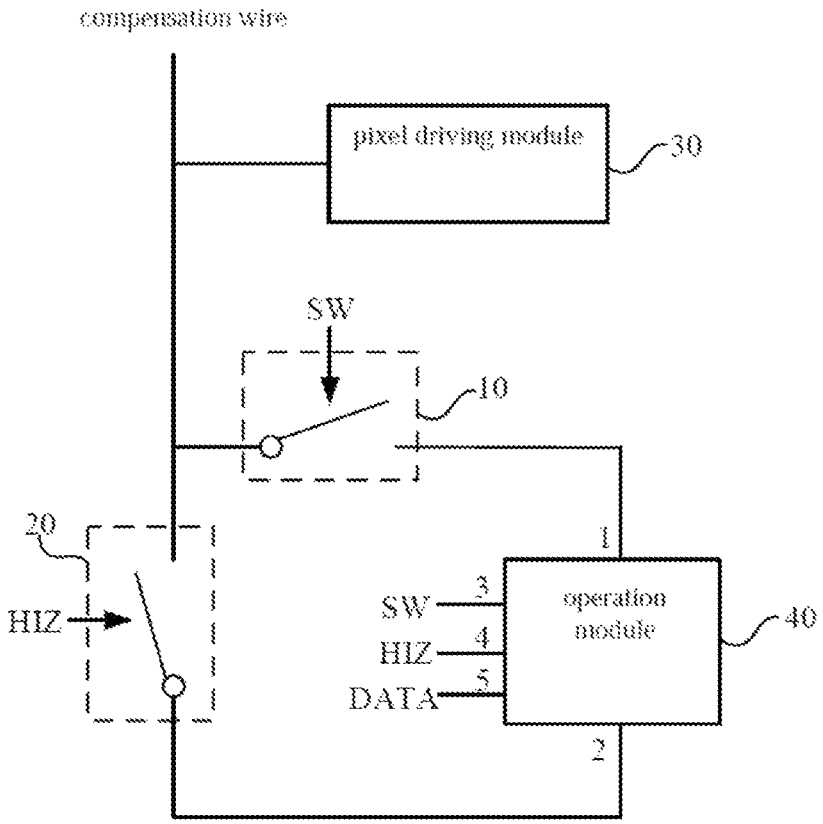
FIG. 2 is a schematic structure diagram of a pixel driving circuit according to another embodiment of the present disclosure.

In an embodiment, as shown in FIG. 2, a control terminal of the first switch unit 10 is connected to a first control signal SW; a control terminal of the second switch unit 20 is connected to a second control signal HIZ; when the first control signal SW and the second control signal HIZ are at a low level, both the first switch unit 10 and the second switch unit 20 are turned on; when the first control signal SW and the second control signal HIZ are at a high level, both the first switch unit 10 and the second switch unit 20 are turned off In an embodiment, please continue to refer to FIG. 2, a third terminal of the operation module 40 (indicated by the sign "3" on the operation module 40 in FIG. 2) is connected to the first control signal SW; a fourth terminal of the operation module 40 (indicated by the sign "4" on the operation module 40 in FIG. 2) is connected to the second control signal HIZ; a fifth terminal of the operation module 40 (indicated by the sign "5" on the operation module 40 in FIG. 2) is connected to the data signal DATA.

Figure 3:
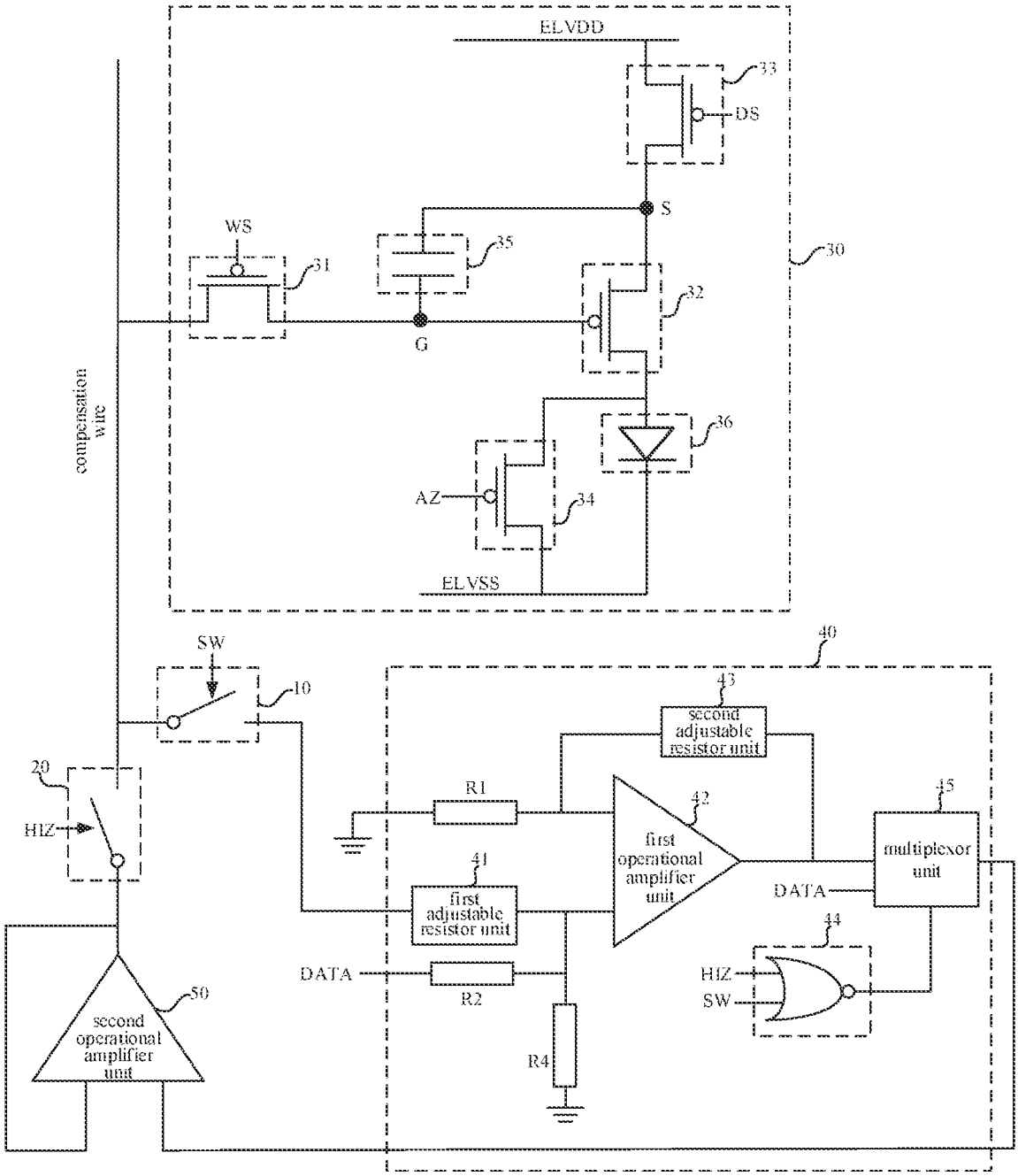
FIG. 3 is a schematic diagram of a circuit principle of a pixel driving circuit according to another embodiment of the present disclosure.

In an embodiment, as shown in FIG. 3, the pixel driving module 30 includes a first transistor 31, a second transistor 32, a third transistor 33, a fourth transistor 34, an energy storage unit 35 and a light emitting unit 36. A source of the first transistor 31 is connected to the compensation wire; a gate of the first transistor 31 is connected to a first scan signal WS; a drain of the first transistor 31, a first terminal of the energy storage unit 35 and a gate of the second transistor 32 are electrically connected to a first voltage node G. A source of the second transistor 32, a second terminal of the energy storage unit 35 and a drain of the third transistor 33 are electrically connected to a second voltage node S. A drain of the second transistor 32 is electrically connected to a first power supply wire ELVSS through the light emitting unit 36. The drain of the third transistor 33 is connected to the second power supply wire ELVDD; the gate of the third transistor 33 is connected to a second scan signal DS. A gate of the fourth transistor 34 is connected to the third scan signal AZ; a drain of the fourth transistor 34 is connected to the drain of the second transistor 32; and a source of the fourth transistor 34 is connected to the first power supply wire ELVSS. The internal structure of the pixel driving module 30 is 4T1C. Compared to the 4T2C structure of the pixel driving module in the conventional display, the number of internal capacitor elements is reduced, and the difference in the some parameters of the capacitor fabrication process is eliminated, which is conducive to implementing the high-resolution display.

As an example, the first transistor 31, the second transistor 32, the third transistor 33 and the fourth transistor 34 are all PMOS transistors; the energy storage unit 35 includes an energy storage capacitor; and the light emitting unit 36 includes a light emitting diode.

In an embodiment, please continue to refer to FIG. 3, the operation module 40 includes a first operational amplifier unit 42, a multiplexor unit 45, a NOR unit 44, a first adjustable resistor unit 41 and a second adjustable resistor unit 43. An input terminal of the first adjustable resistor unit 41 is connected to the data signal DATA; a first input terminal of the first operational amplifier unit 42 serves as the first port of the operation module 40; and the second input terminal of the first operational amplifier unit 42 is connected to the output terminal of the first adjustable resistor unit 41 and the ground GND; the first terminal of the second adjustable resistor unit 43 is connected to the first input terminal of the first operational amplifier unit 42; and the second terminal of the second adjustable resistor unit 43 is connected to the output terminal of the first operational amplifier unit 42. The first input terminal of the NOR unit 44 is connected to the first control signal SW; the second input terminal of the NOR unit 44 is connected to the second control signal HIZ; and the output terminal of the NOR unit 44 is connected to the control terminal of the multiplexor unit 45; the first input terminal of the multiplexor unit 45 is connected to the data signal DATA; the second input terminal of the multiplexor unit 45 is connected to the output terminal of the first operational amplifier unit 42; and the output terminal of the multiplexor unit 45 serves as the second port.

Specifically, the data signal DATA is configured to provide a first preset voltage Vofs to the multiplexor unit 45 in an initialization phase, and to provide a second preset voltage Vdata to the first operational amplifier unit 42 in the self-discharge phase. The first operational amplifier unit 42 is configured to perform the calculation according to the driving data and the second preset voltage Vdata in the self-discharge phase to obtain the compensation data. The multiplexor unit 45 selects the first preset voltage Vofs provided by the output data signal DATA in the initialization phase to output, and selects and outputs the compensation data provided by the first operational amplifier unit 42 in the self-discharge phase and the data writing phase.

As an example, in the self-discharge phase, the driving data provided by the pixel driving module 30 is voltage data of the first voltage node G.

In an embodiment, the second preset voltage Vdata is greater than the first preset voltage Vofs.

As an example, the multiplexor unit 45 includes, but is not limited to, a two-to-one data selector; the NOR unit 44 includes, but is not limited to, a NOR gate; the first operational amplifier unit 42 includes, but is not limited to, an operational amplifier.

In an embodiment, the operation module 40 further includes a first resistor R1 and a second resistor R2. A first terminal of the first resistor R1 is connected to the compensation wire via the first switch unit 10; a second terminal of the first resistor R1 is connected to the first terminal of the second adjustable resistor unit 43; a first terminal of the second resistor R2 is grounded GND; a second terminal of the second resistor R2 is connected to the output terminal of the first adjustable resistor unit 41. In order to facilitate the internal operation of the operation module 40 in the self-discharge phase, a resistance value of the first resistor R1 and a resistance value of the second resistor R2 are set equal to each other.

Figure 4:
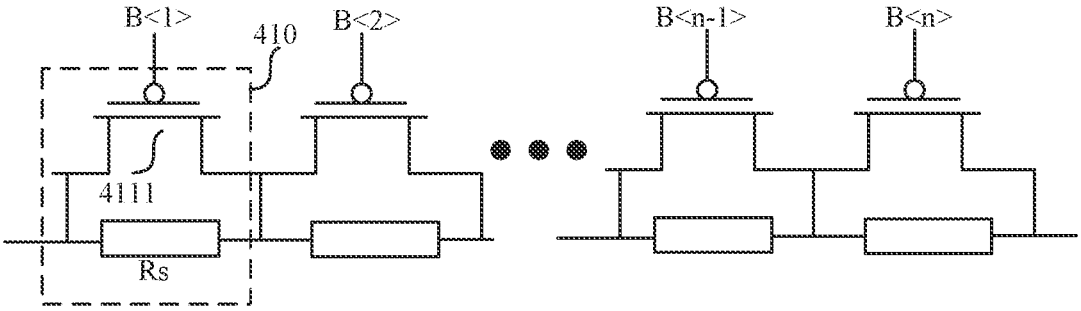
FIG. 4 is a schematic diagram of a circuit principle of a first adjustable resistor unit and a second adjustable resistor unit according to an embodiment of the present disclosure.

In an embodiment, as shown in FIG. 4, both the first adjustable resistor unit 41 and the second adjustable resistor unit 43 include a plurality of adjustable resistor sub-units 410 connected in series; each adjustable resistor sub-unit 410 includes a preset resistor Rs and a switch transistor 4111 corresponding to the preset resistor Rs. A first terminal of the switch transistor 4111 is connected to a first terminal of the preset resistor Rs; and a second terminal of the switch transistor 4111 is connected to a second terminal of the preset resistor Rs; a control terminal of the switch transistor 4111 is connected to corresponding preset control signals B<1>, B<2> . . . B<n−1>, B<n>.

Specifically, the above-mentioned plurality of switch transistors 4111 are all PMOS tubes; resistance values of the plurality of preset resistors Rs can be the same or different; for the convenience of setting a relationship that the resistance value of the first adjustable resistor unit 41 is the same as the resistance value of the second adjustable resistor unit 43, the resistance values of the plurality of preset resistors Rs are set to be the same. A time sequence state of the preset control signal in the self-discharge phase is adjusted, and the corresponding switch transistor 4111 is controlled to turn on or off, to adjust the resistance value of the first adjustable resistor unit 41 to be equal to the resistance value of the second adjustable resistor unit 43.

In an embodiment, please continue to refer to FIG. 3, the pixel driving circuit further includes: a second operational amplifier unit 50. A first input terminal of the second operational amplifier unit 50 is connected to the second port (i.e., the output terminal of the multiplexor unit 45); a second input terminal of the second operational amplifier unit 50 is connected to the output terminal of the second operational amplifier unit; and the output terminal of the second operational amplifier unit 50 is connected to the compensation wire, thereby improving the transmission effect of the compensation data.

As an example, the second operational amplifier unit 50 includes, but is not limited to, an operational amplifier.

Figure 5:
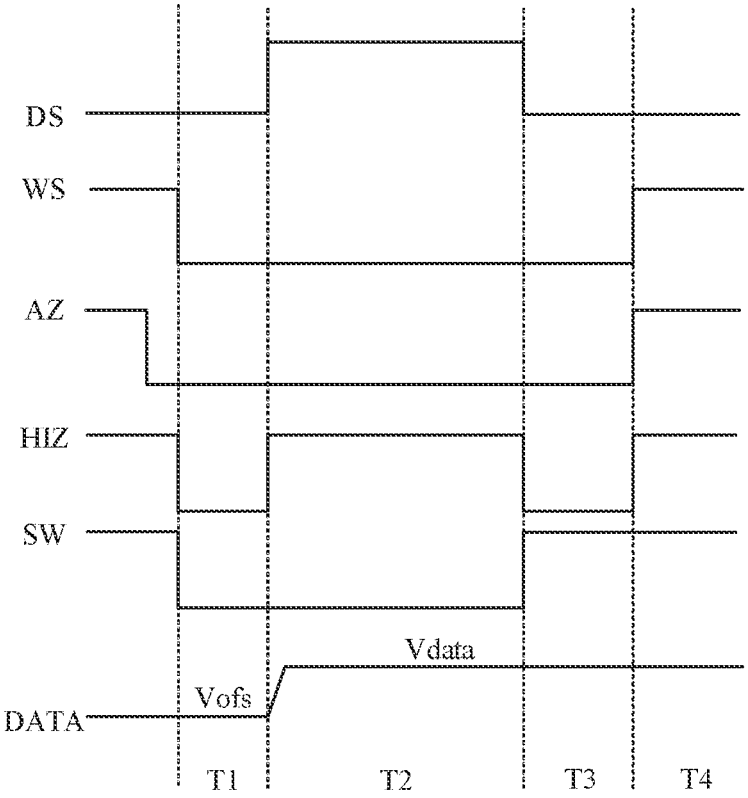
FIG. 5 is a schematic working sequential chart of the pixel driving circuit shown in FIG. 3.

In an embodiment, as shown in FIG. 5, in order to explain the compensation principle of the operation module 40 to the pixel driving module 30 in detail, the operating state of the pixel driving circuit includes an initialization phase, a self-discharge phase, a data writing phase and a light emitting phase in sequence. The operating principle of the pixel driving circuit in the embodiment is described below in conjunction with the operating states of each component in the above-mentioned four phases.

In the initialization phase (indicated by T1 in FIG. 5), the first switch unit 10, the second switch unit 20, the first transistor 31, the second transistor 32, the third transistor 33 and the fourth transistor 34 are all turned on. The multiplexor unit 45 selects and outputs the first preset voltage Vofs provided by the data signal DATA; the first preset voltage Vofs is written into the first voltage node G, and the second voltage node S is written into the ELVD; an initial gate-source voltage Vini of the second transistor 32 is defined to satisfy Vini=Vofs−ELVDD, to complete the initialization phase.

In the self-discharge phase (as shown by T2 in FIG. 5), the first switch unit 10, the first transistor 31, the second transistor 32 and the fourth transistor 34 are all turned on; while the second switch unit 20 and the third transistor 33 are both turned off. The second voltage node G is connected to the first operational amplifier unit 42; the energy storage unit 35 discharges outward, and the gate-source voltage of the second transistor 32 remains unchanged. When the threshold voltage Vth of the second transistor 32 increases to the initial gate-source voltage Vini due to the substrate bias effect, then the discharge ends, and the second transistor 32 is turned off at this time. A final threshold voltage of the second transistor 32 satifies $Vth_{_EF}=\alpha*(ELVDD-Vs)+|Vth|=Vini$; where ELVDD is a substrate voltage, a is a substrate bias effect coefficient of the second transistor 32 and is related to the fabrication process, and Vs is a voltage of the second voltage node S when the discharge is finished.

Each pixel driving circuit drives a corresponding light emitting diode; and the transistors in each pixel driving circuit have a threshold voltage difference $\Delta Vth=|V_{th2}|-|V_{th1}|$; according to a derivation $Vini=\alpha*(ELVDD-Vs1)+|Vth1|=\alpha*(ELVDD-Vs2)+|V_{th2}|$, an equation $\Delta Vth=\alpha*(Vs2-Vs1)$ can be obtained, i.e., $\Delta Vth=\alpha*(Vg2-Vg1)$, where Vth1 is the threshold voltage of pixel 1, Vth2 is the threshold voltage of pixel 2, Vs1 is the S point voltage of the pixel driving circuit 1, Vs2 is the S point voltage of the pixel driving circuit 2, Vg1 is the G point voltage of the pixel driving circuit 1, and Vg2 is the G point voltage of the pixel driving circuit 2; pixel 1 and pixel 2 are pixels at two different positions.

The resistance value of the first adjustable resistor unit 41 is set to be equal to the resistance value of the second adjustable resistor unit 43, and the resistance value of the first resistor R1 is equal to the resistance value of the second resistor R2, then the compensation data Vdata−β*Vg outputted from the first operational amplifier unit 42 can be obtained. The multiplexor unit 45 selects and outputs the compensation data Vdata−β*Vg, where β=resistance value of the second resistance adjustable unit 43/R1.

In the data writing phase (as indicated by T3 in FIG. 5), the second switch unit 20, the first transistor 31, the second transistor 32, the third transistor 33 and the fourth transistor 34 are all turned on, while the first switch unit 10 is turned off, to write the compensation data Vdata-β*Vg into the first voltage node G.

In the light emitting phase (as indicated by T4 in FIG. 5), the driving current of the pixel 1 satisfies:

$$I1=\frac{1}{2}C_{ox}u_p\frac{W}{L}(ELVDD-V\text{data}+Vg1*\beta-|Vth1|)^2;$$

the driving current of the pixel 2 satisfies:

$$I2=\frac{1}{2}C_{ox}u_p\frac{W}{L}[ELVDD-V\text{data}+Vg2*\beta-(|Vth1|+\Delta Vth)]^2;$$

$$Vg2=Vg1+\frac{\Delta Vth}{\alpha}$$

is substituted into I2 to obtain:

$$I2=\frac{1}{2}C_{ox}u_p\frac{W}{L}\left[ELVDD-V\text{data}+Vg1*\beta-|Vth1|+\left(\frac{\beta}{\alpha}-1\right)\Delta Vth\right]^2;$$

where, $C_{ox}$ is a thickness of a gate oxide of the second transistor 32, $u_p$ is a hole mobility of a channel of the second transistor 32, W is a channel width of the second transistor 32, and L is a channel length of the second transistor 32, β=resistance value of the second adjustable resistor unit 43/the resistance value of R1; the resistance value of R1 can remain fixed; and the resistance value of the second adjustable resistor unit 43 is adjusted such that $$\frac{\beta}{\alpha}=1,$$

that is, the driving current I2 of the pixel 2 is equal to the driving current I1 of the pixel 1, and there is no difference between the light intensities of the pixel 1 and the pixel 2, thereby completing the external compensation.

In an embodiment of the present disclosure, a display device is further provided, which includes a first switch unit 10, a second switch unit 20, a pixel driving module 30 and an operation module 40. A first port of the operation module 40 is connected to a compensation wire connected to the pixel driving module 30 via the first switch unit 10; and a second port of the operation module 40 is connected to the compensation wire via the second switch unit 20.

Specifically, the first switch unit 10 is configured to transmit data to the operation module 40 in the self-discharge phase; the operation module 40 is configured to perform calculation on driving data provided by the pixel driving module 30 in the self-discharge phase to obtain compensation data; the second switch unit 20 is configured to write the compensation data into the pixel driving module 30 via the compensation wire in the data writing phase.

Figure 6:
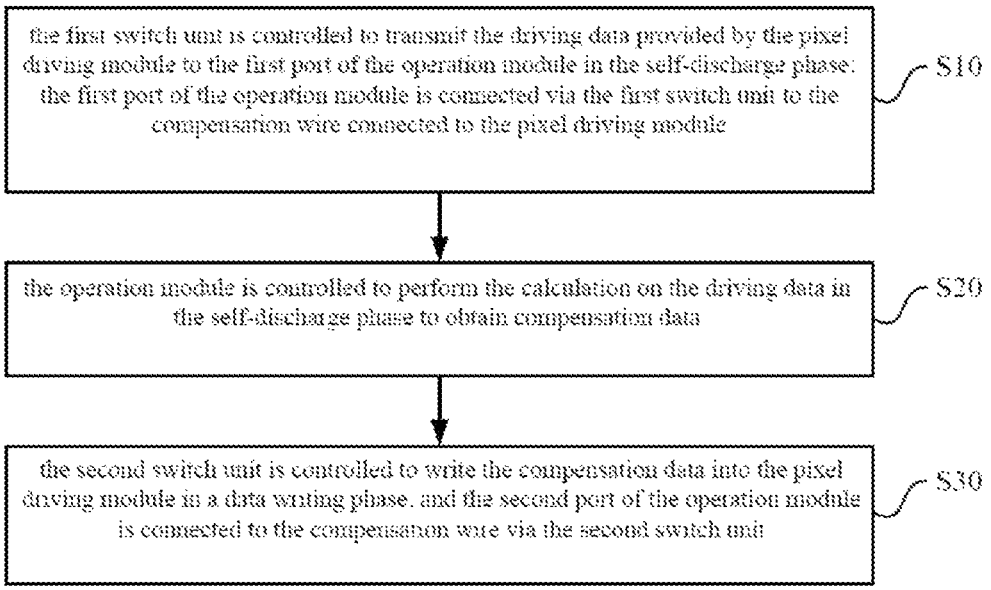
FIG. 6 is a schematic flowchart showing a pixel driving method according to an embodiment of the present disclosure.

In an embodiment of the present disclosure, as shown in FIG. 6, a pixel driving method is further provided, which is performed based on the above pixel driving circuit and includes the following steps.

Step S10: the first switch unit 10 is controlled to transmit the driving data provided by the pixel driving module 30 to the first port of the operation module 40 in the self-discharge phase; the first port of the operation module 40 is connected via the first switch unit 10 to the compensation wire connected to the pixel driving module 30.

Step S20: the operation module 40 is controlled to perform the calculation on the driving data in the self-discharge phase to obtain compensation data.

Step S30: the second switch unit 20 is controlled to write the compensation data into the pixel driving module 30 in a data writing phase, and the second port of the operation module 40 is connected to the compensation wire via the second switch unit 20.

For the specific definition of the pixel driving method in the above-mentioned embodiments, reference can be made to the definition of the pixel driving circuit above, which will not be repeated here.

It should be understood that the steps described are not strictly limited to the order in which they are performed, and that the steps may be performed in other orders, unless explicitly stated herein. Moreover, at least a part of the described steps may include multiple sub-steps or multiple stages. These sub-steps or stages are not definitely executed and completed at the same time, but may be executed at different time. The order of execution is also not definitely sequential, but may be performed in turns or alternately with other steps or sub-steps of other steps or at least a portion of a phase.

Those of ordinary skill in the art can understand that all or part of the processes in the methods of the above embodiments can be implemented by instructing relevant hardware through a computer program, and the computer program can be stored in a non-transitory computer-readable storage medium, when the computer program is executed, the processes of the above-mentioned method embodiments can be implemented. Any reference to memory, storage, database or other medium used in the various embodiments provided in the present disclosure may include non-transitory and/or transitory memory.

Note that the above-described embodiments are for illustrative purposes only and do not intend to limit the present disclosure.

The various embodiments in the disclosure are described in a progressive manner, and each embodiment focuses on the differences from other embodiments. For the same and similar parts between the various embodiments, refer to each other.

The technical features of the above-described embodiments can be combined arbitrarily. For the sake of brevity, all possible combinations of the technical features in the above-described embodiments are not described. However, as long as there is no contradiction between the combinations of these technical features, all should be regarded as the scope of the present disclosure.

The above-mentioned embodiments are merely some embodiments of the present disclosure, and the descriptions thereof are more specific and detailed, but should not be construed as a limitation on the scope of the disclosure. It should be pointed out that those skilled in the art can make several modifications and improvements without departing from the concept of the present disclosure, and the modifications and improvements all belong to the protection scope of the present disclosure. Therefore, the protection scope of the present disclosure shall be subject to the appended claims.

What is claimed is:

1. A pixel driving circuit, comprising:

a first switch unit, a second switch unit, a pixel driving module, an operation module; wherein a first port of the operation module is connected via the first switch unit to a compensation wire connected to the pixel driving module, a second port of the operation module is connected to the compensation wire via the second switch unit;

wherein the first switch unit is configured to transmit driving data provided by the pixel driving module to the operation module in a self-discharge phase, the operation module is configured to perform calculation on the driving data in the self-discharge phase to obtain compensation data, the second switch unit is configured to write the compensation data into the pixel driving module via the compensation wire in a data writing phase.

2. The pixel driving circuit according to claim 1, wherein the first switch unit is further configured to disconnect the compensation wire from the first port in the data writing phase, the second switch unit is further configured to disconnect the second port from the compensation wire in the self-discharge phase.

3. The pixel driving circuit according to claim 1, wherein the operation module comprises a first operational amplifier unit, a multiplexor unit, a NOR unit, a first adjustable resistor unit and a second adjustable resistor unit;

an input terminal of the first adjustable resistor unit is connected to a data signal;

a first input terminal of the first operational amplifier unit serves as the first port, a second input terminal of the first operational amplifier unit is connected to the output terminal of the first adjustable resistor unit and is grounded, the data signal is configured to provide a first preset voltage to the multiplexor unit in an initialization phase and provide a second preset voltage to the first operational amplifier unit in the self-discharge phase, the first operational amplifier unit performs the calculation and obtains the compensation data according to the driving data and the second preset voltage in the self-discharge phase;

a first terminal of the second adjustable resistor unit is connected to the first input terminal of the first operational amplifier unit, a second terminal of the second adjustable resistor unit is connected to the output terminal of the first operational amplifier unit;

a first input terminal of the NOR unit is connected to a first control signal, a second input terminal of the NOR unit is connected to a second control signal, an output terminal of the NOR unit is connected to a control terminal of the multiplexor unit;

a first input terminal of the multiplexor unit is connected to the data signal, a second input terminal of the multiplexor unit is connected to the output terminal of the first operational amplifier unit, and an output terminal of the multiplexor unit serves as the second port, the multiplexor unit selects and outputs the first preset voltage provided by the data signal in the initialization phase, and selects and outputs the compensation data provided by the first operational amplifier unit in the self-discharge phase and the data writing phase.

4. The pixel driving circuit according to claim 3, wherein the operation module further comprises:

a first resistor, wherein a first terminal of the first resistor is connected to the compensation wire via the first switch unit, and a second terminal of the first resistor is connected to the first terminal of the second adjustable resistor unit;

a second resistor, wherein a first terminal of the second resistor is grounded, and a second terminal of the second resistor is connected to the output terminal of the first adjustable resistor unit.

5. The pixel driving circuit according to claim 3, wherein the second preset voltage is greater than the first preset voltage.

6. The pixel driving circuit according to claim 3, wherein a resistance value of the first adjustable resistor unit is equal to a resistance value of the second adjustable resistor unit.

7. The pixel driving circuit according to claim 6, wherein both the first adjustable resistor unit and the second adjustable resistor unit comprise a plurality of adjustable resistor sub-units connected in series;

each adjustable resistor sub-unit comprises a preset resistor and a switch transistor corresponding to the preset resistor, a first terminal of the switch transistor is connected to a first terminal of the preset resistor, a second terminal of the switch transistor is connected to a second terminal of the preset resistor, a control terminal of the switch transistor is connected to a corresponding preset control signal.

8. The pixel driving circuit according to claim 1, comprising a first transistor, a second transistor, a third transistor, a fourth transistor, an energy storage unit and a light emitting unit; wherein a source of the first transistor is connected to the compensation wire, a gate of the first transistor is connected to a first scan signal; a drain of the first transistor, a first terminal of the energy storage unit and a gate of the second transistor are electrically connected to a first voltage node; a source of the second transistor, a second terminal of the energy storage unit and a drain of the third transistor are electrically connected to a second voltage node; a drain of the second transistor is electrically connected to a first power supply wire via the light emitting unit;

a source of the third transistor is connected to a second power supply wire, and a gate of the third transistor is connected to a second scan signal;

a gate of the fourth transistor is connected to a third scan signal, a drain of the fourth transistor is connected to the drain of the second transistor, and a source of the fourth transistor is connected to the first power supply wire.

9. The pixel driving circuit according to claim 8, wherein the first transistor, the second transistor, the third transistor and the fourth transistor are PMOS transistors.

10. The pixel driving circuit according to claim 1, further comprising:

a second operational amplifier unit, wherein a first input terminal of the second operational amplifier unit is connected to the second port, a second input terminal of the second operational amplifier unit is connected to the output terminal of the second operational amplifier unit, and the output terminal of the second operational amplifier unit is connected to the compensation wire.

11. A display device, comprising:

a first switch unit;

a second switch unit;

a pixel driving module;

an operation module, wherein a first port of the operation module is connected via the first switch unit to a compensation wire connected to the pixel driving module, a second port of the operation module is connected to the compensation wire via the second switch unit;

wherein the first switch unit is configured to transmit driving data provided by the pixel driving module to the operation module in a self-discharge phase, the operation module is configured to perform calculation on the driving data in the self-discharge phase to obtain compensation data, the second switch unit is configured to write the compensation data into a light emitting unit of the pixel driving module via the compensation wire in a data writing phase to display.

12. A pixel driving method, comprising:

controlling a first switch unit to transmit driving data provided by a pixel driving module to a first port of an operation module in a self-discharge phase; wherein the first port of the operation module is connected via the first switch unit to a compensation wire connected to the pixel driving module;

controlling the operation module to perform calculation on the driving data in the self-discharge phase to obtain compensation data;

controlling a second switch unit to write the compensation data into the pixel driving module in a data writing phase, wherein a second port of the operation module is connected to the compensation wire via the second switch unit.

* * * * *